US005201160A

United States Patent [19]

Sanchez

[11] Patent Number: 5,201,160

[45] Date of Patent: Apr. 13, 1993

[54] MULTIPLE-LAYER SPACE-FRAMING PLATE OF RODS

[75] Inventor: Jaime Sanchez, Randersacker-Lindelbach, Fed. Rep. of Germany

[73] Assignee: Mero-Raumstruktur, Wurzburg, Fed. Rep. of Germany

[21] Appl. No.: 728,730

[22] Filed: Jul. 11, 1991

[51] Int. Cl.[5] ..... E04B 1/19

[52] U.S. Cl. ..... 52/645; 52/DIG. 10

[58] Field of Search ..... 52/DIG. 10, 645, 648, 52/660

[56] References Cited

U.S. PATENT DOCUMENTS 3,942,291 3/1976 Hirata et al. .
3,970,301 7/1976 Lehmann .
4,686,800 8/1987 McCormick .
4,719,726 1/1988 Bergmann .

FOREIGN PATENT DOCUMENTS

3627633A1 2/1988 Fed. Rep. of Germany .
8804714 6/1988 World Int. Prop. O. .

OTHER PUBLICATIONS

Spaced Grid Structures, John Borrego, The MIT Press, Cambridge, Massachusetts (1969), pp. 107 and 196a.

*Primary Examiner*—James L. Ridgill, Jr.
*Attorney, Agent, or Firm*—Frank P. Presta

[57] ABSTRACT

In the case of a known multiple-layer space-framing plate of rods and gusseted joints, which consists of a plurality of circular meshwork arrangements which are connected with one another, which extend as a honeycomb in a space, the circular meshworks define hollow spaces which are open to the outside, in the area of which no brackets are present for attachment of roofing or side wall coverings. Because of the dimensions of the openings on the top or the side walls of the space-framing plate, it is therefore not suitable for use in roof construction. The invention provides for a "cut out" or "design" of the space-framing plate in such a manner that in the hollow spaces which are open to the outside on the top and on the side walls of the space-framing plate which is to be cut to size, two-layer complementary space-framing elements can be incorporated in such a manner that on the top and on the side walls of the space-framing plate a screen of rods and gusseted joints is present, arranged in a plane.

11 Claims, 15 Drawing Sheets

(9×T)+(3×½O)+(1×O)+(3×½CO)
(6×½CO) + (1×O)
(3×½O)+(4×T)
C
CO
3×
3×
1
2
3
6
7
11
14
15
16

MULTIPLE-LAYER SPACE-FRAMING PLATE OF RODS

BACKGROUND OF THE INVENTION

The invention relates to a multi-layer space-framing plate made up of rods and gusseted joints, consisting of a plurality of circular meshworks which are connected together, extending along a honeycombed base structure, wherein the circular meshworks are composed of elementary building blocks which may be an assembly of cuboctahedrons, octahedrons and parts of the same, and in which furthermore the circular meshworks also define hollow spaces which are open to the outside.

A multiple-layer space-framing plate of this sort is known from German Published Specification (Offenlegungsschrift) 3 627 633. Because of the special construction this space-framing plate can be constructed with larger span width or length than has been possible until this time with the traditional 2-layer or 3-layer space-framing plates. One problem of this known space-framing plate however resides in that on account of the numerous large openings in its top and side walls it cannot be used for roof construction without application of more parts. In the area of the openings the gusseted joints required as stringers and brackets for the roofing elements or side wall coverings are not present. In other words, the dimensions of these openings in the circular meshworks of this space-framing plate are too large to be simply spanned over by roofing or side wall coverings.

SUMMARY OF THE INVENTION

Therefore the object of the invention is to develop a multiple-layer space-framing plate of the aforementioned type of structure in such a manner that its hollow spaces which are open to the outside on the top and the side walls are closed by means of additional space-framing elements, so that even in these areas sufficient bearing points and fastening points are present for a roofing element or side wall covering.

The object of the invention is attained in that the space-framing plate is of such dimensions that two-layer complementary space-framing elements can be placed in the hollow spaces which are open to the outside on the top and the side walls of the cut-out space-framing plate, in such a manner that a screen of rods and gusseted joints is present, arranged in a plane, on both the top and the side walls of the space-framing plate. These complementary space-framing elements can advantageously be composed predominantly of the same elementary structural blocks as the circular meshworks of the space-framing plate. Tetrahedral, rectangular prisms and semi-rectangular prisms are generally required as additional elementary structural blocks. One further essential advantage of the invention resides in that in the outermost layer on the topside and the side walls of the multiple-layer space-framing plate it has gusseted joints arranged in the screen, to which can be either directly or indirectly fastened a roofing or side wall coverings. Finally also in the case of the complementary space-framing elements there are only two rod lengths in the ratio of 1:2 and two types of angles (45° and 60°).

Some advantageous configurations of the invention are disclosed in the dependent claims.

BRIEF DESCRIPTION OF THE DRAWINGS

The invention is to be described in greater detail hereinafter relative to the drawings of the exemplary embodiments. In the drawings.

DESCRIPTION OF THE PREFERRED EMBODIMENTS

Figure 1:
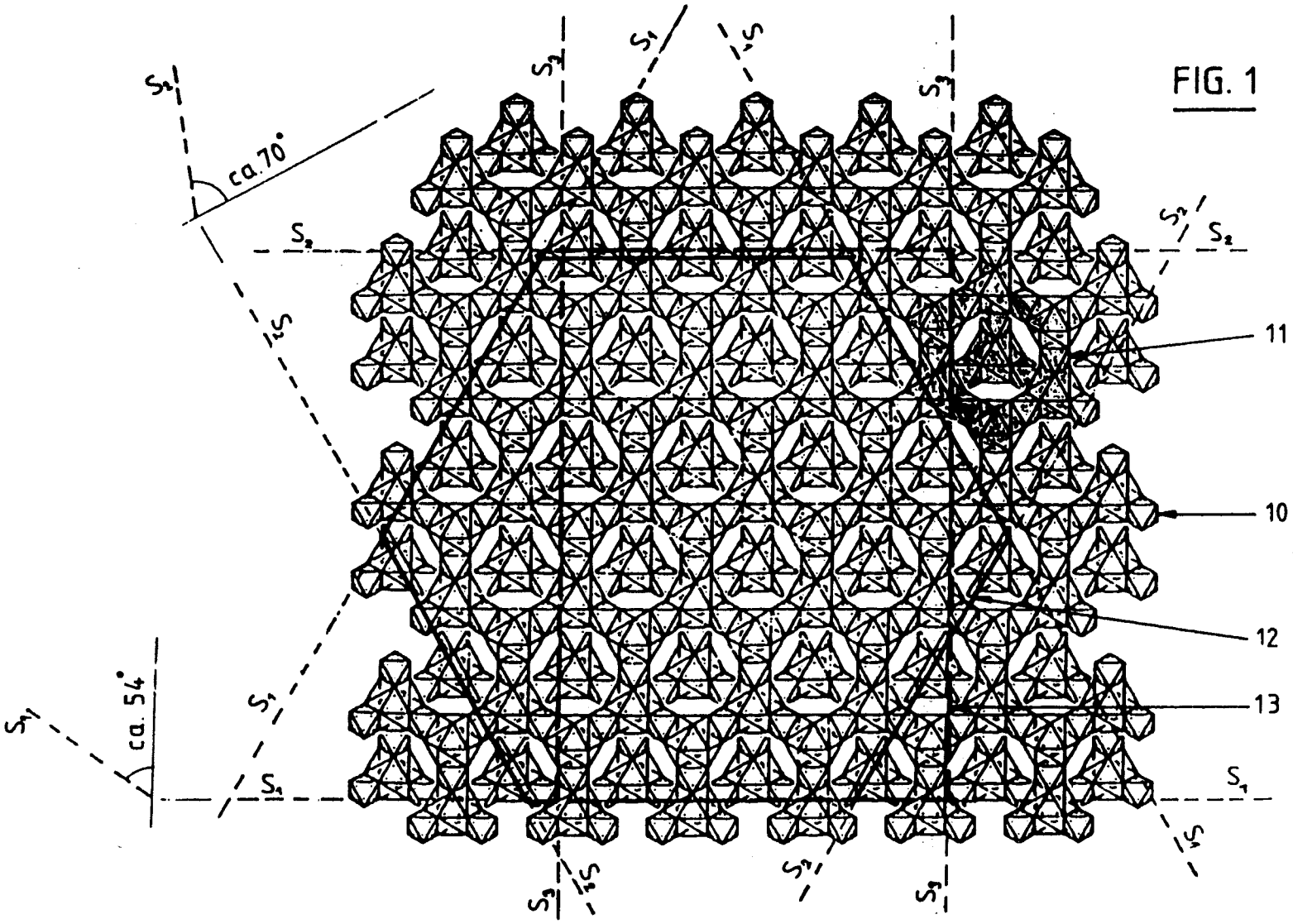
FIG. 1 is a plan view of a known six-layer space-framing plate of a plurality of circular meshworks which are connected with one another, in which full lines and broken lines indicate respectively a "to-be-shaped" space-framing plate which is hexagonal or rectangular at its base.
Figure 2:
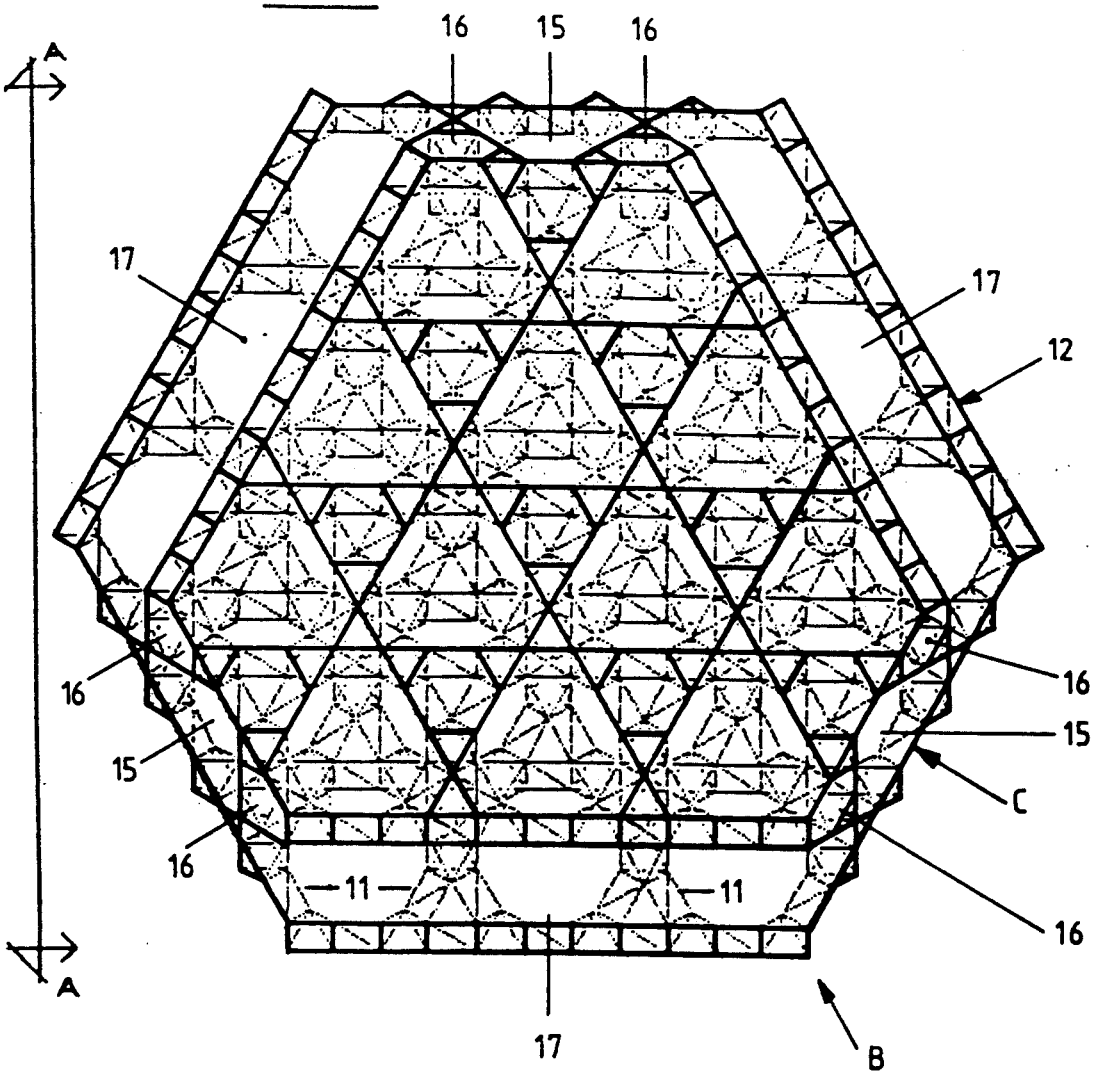
FIG. 2 is a plan view of the six-layer space-framing plate with hexagonal base design for incorporation of the complementary space-framing elements.

The space-framing plate 10 shown in FIG. 1 has a plurality of honeycombed circular elements extending spatially over six layers and connected one over the other to form the layers of meshworks, of which one for instance, with the reference 11 in FIG. 1, characteristically represents all of the others. These circular meshwork arrangements 11 consist in turn of elementary structural blocks and each elementary structural block incorporates a series of cuboctahedrons, octahedrons and half-cuboctahedrons reinforced by diagonal rods.

Starting with this state of the art, suitable space-framing plates 10 are "separated out" along separation lines S1, S2 and S3 which for instance define a space-framing plate 12 with hexagonal base line or a space-framing plate 13 with rectangular base line, for clarification of the invention. Space-framing plate 12 is indicated in FIG. 1 in full lines and space-framing plate 13 in broken lines. The side walls of space-framing plate 12 have alternatively an inclination of approximately 54° or approximately 70° from the horizontal, while space-framing plate 13 with rectangular base line along cut lines S3 incorporates vertical side walls and along cut lines S1 and S2 with an inclination of approximately 54° and approximately 70°.

Figures 6, 6A, 6B, 6C:
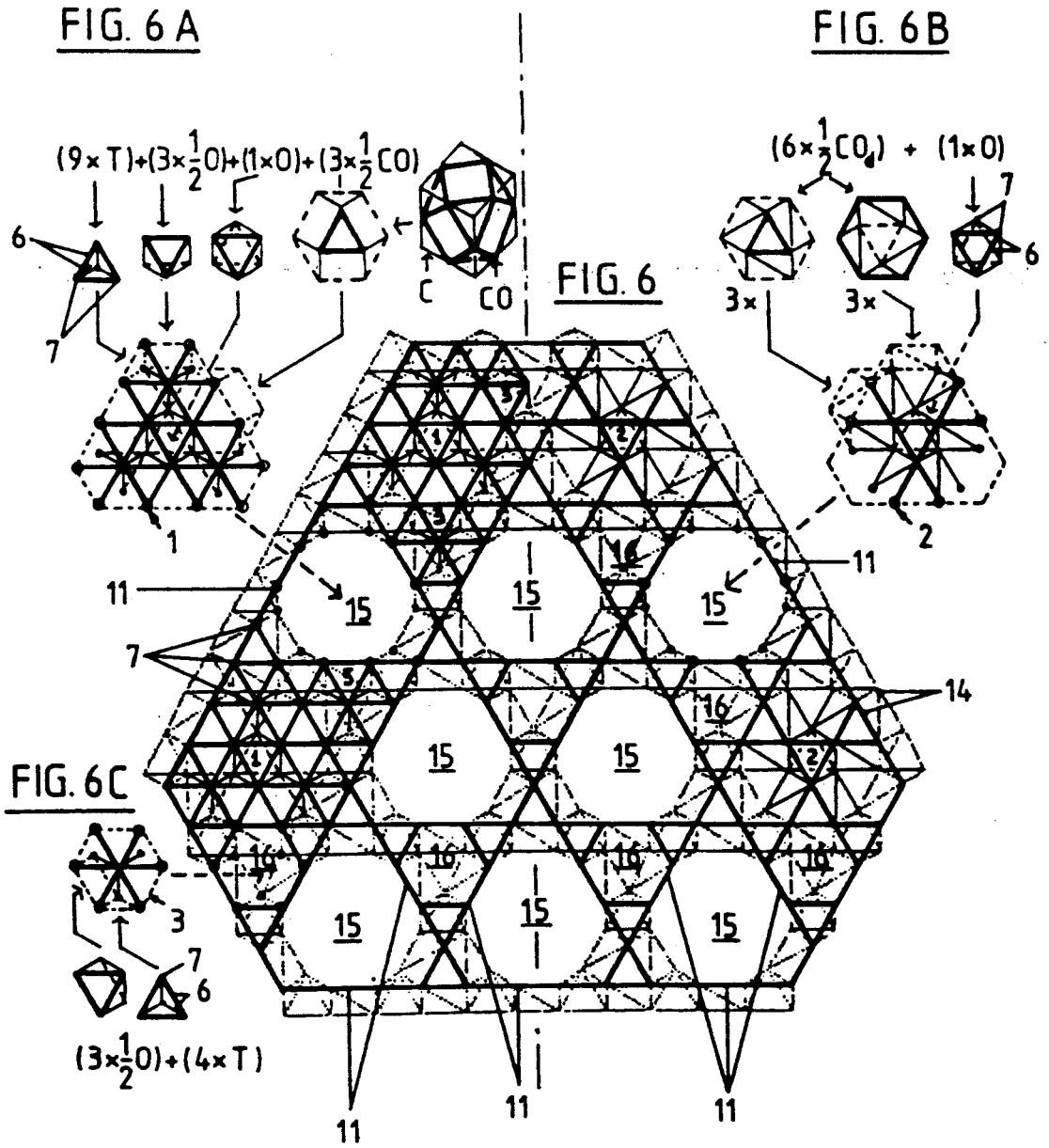
FIG. 6 is a plan view of the two layers at the top of the space-framing plate of FIGS. 2–5, in which a portion of the outward-opening hollow spaces of this space-framing plate are already incorporated into the complementary space-framing elements according to the invention.
FIG. 6A is a first embodiment of a two-layer complementary space-framing element with its typical elementary structural blocks.
FIG. 6B is a second embodiment of a two-layer complementary space-framing element with its typical elementary structural blocks.
FIG. 6C is a third embodiment of a two-layer complementary space-framing element with its typical elementary structural blocks, which can be used together with the embodiments of FIG. 6A or 6B.

In FIG. 6, the two top layers 14 at the top of space-framing plate 12 are shown with the openings 15 and 16 of the hollow spaces which are defined by the circular meshworks 11. These hollow spaces 15 and 16 are to be closed in such a manner that a screen of rods and gusseted joints is present at the top of space-framing plate 12 and is arranged in a plane. Two-layer complementary space-framing elements 1 and 3 or 2 and 3 serve this purpose, and these complementary space-framing elements are shown in FIGS. 6A, 6B and 6C. The two-layer complementary space-framing elements 1 or 2 can if desired be incorporated in the openings 15. The two-layer complementary space-framing element 3 is intended for closing off of openings 16. In FIG. 6 in the left halves of the two top layers 14 of space-framing plate 12, two complementary space-framing elements 1 and three complementary space-framing elements 3 are shown as an exemplary embodiment in the built-in state. In the right halves of the members shown in FIG. 6 for instance two complementary space-framing elements 2 are shown in inserted state.

Two-layer complementary space-framing element 1 is composed of the following elementary structural blocks of rods 6 and gusseted joints 7: Nine tetrahedrons (T), three half-octahedrons (½ O), one octahedron (O) and three half-cuboctahedrons (½ CO). The two-layer complementary space-framing element 2, which can be used as alternative to complementary space-framing element 1, consists of the following elementary structural blocks: six half-cuboctahedrons (½ CO) and one octahedron (O). The two-layer complementary space-framing element 3 includes as elementary structural blocks three half-octahedrons (½ O) and four tetrahedrons (T).

From the above it is learned that two-layer complementary space-framing elements 1, 2 and 3 are composed predominantly of the same elementary structural blocks as the circular meshworks 11 of space-framing plate 12. A not shown roofing element can be fastened to the gusseted joints 7 arranged in the outermost layer 14 of space-framing plate 12, arranged in the triangular screen, and be attached in the traditional manner.

Figure 3:
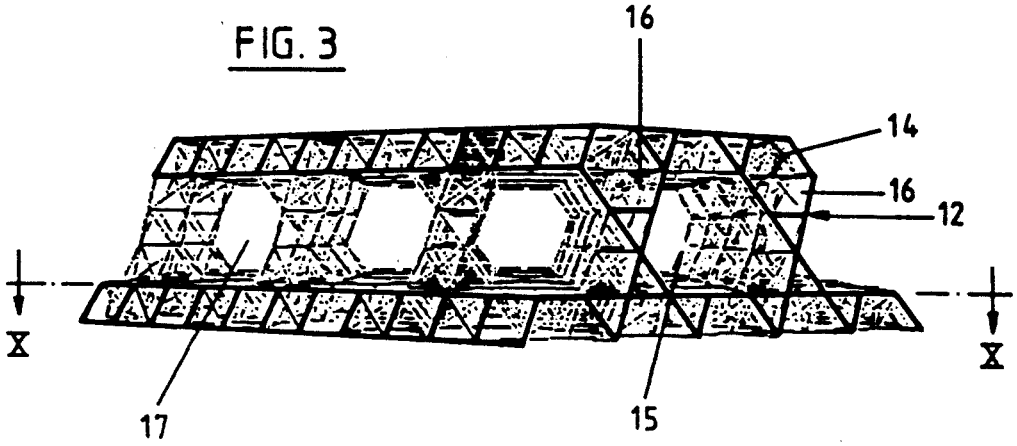
FIG. 3 is a side view of the space-framing plate of FIG. 2 seen from the direction of arrows A—A of FIG. 2.
Figure 4:
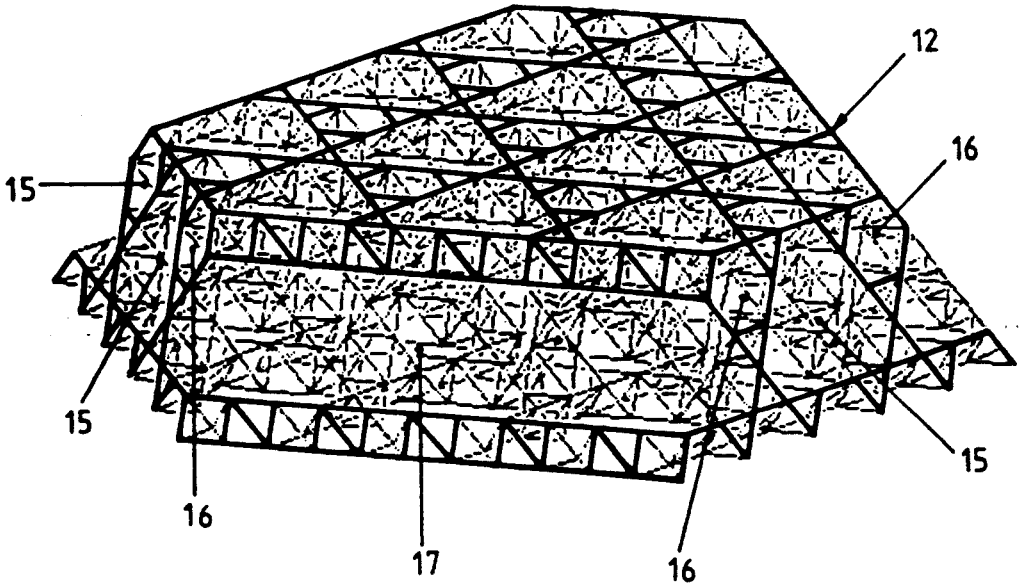
FIG. 4 is a perspective view from above of the space-framing plate of FIG. 2 seen in the direction of the arrow B of FIG. 2.
Figure 5:
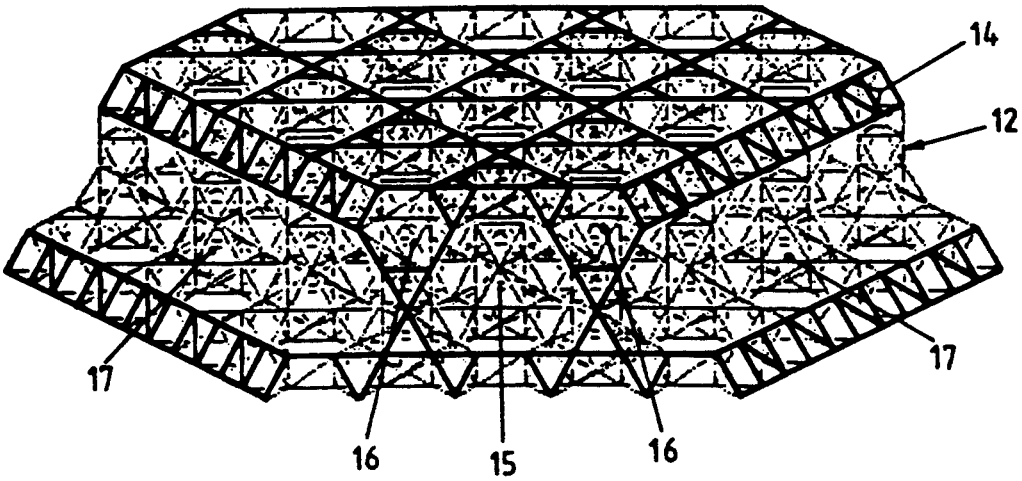
FIG. 5 is another perspective view from above of the space-framing plate of FIG. 2 in the direction of arrow C of FIG. 2.
Figure 7:
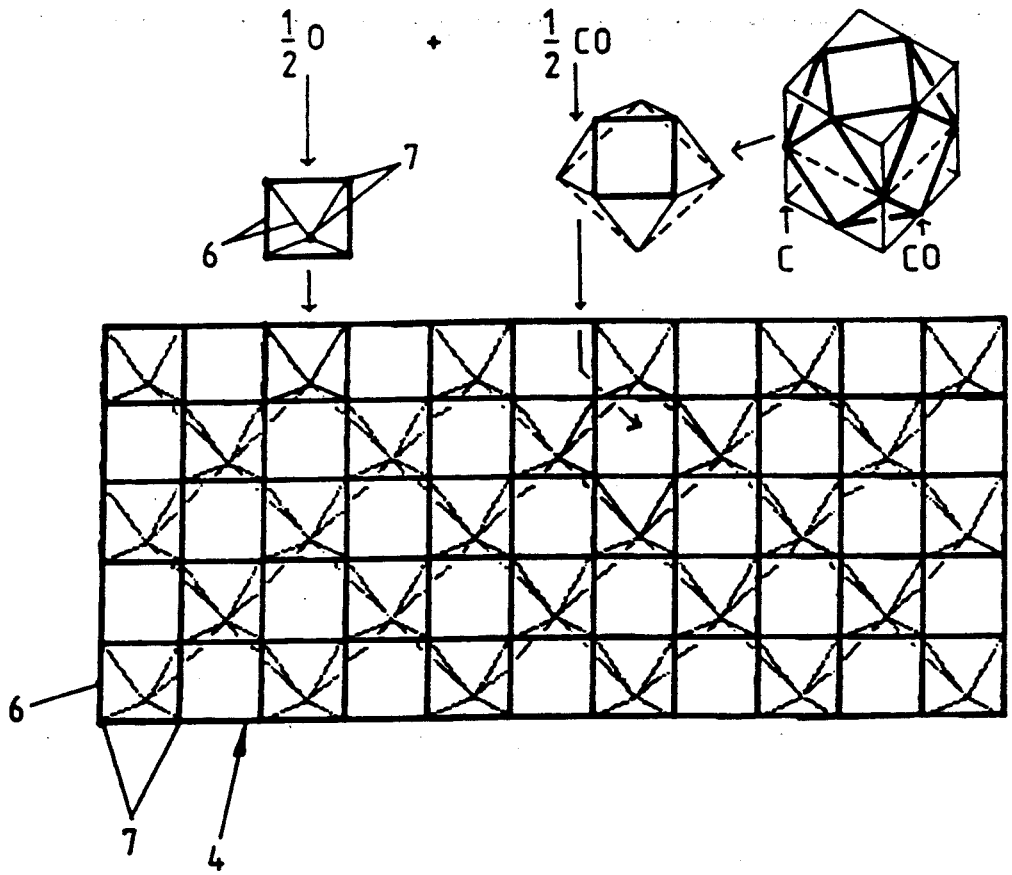
FIG. 7 is a plan view of a fourth embodiment of a two-layer complementary space-framing element and also its typical elementary structural blocks.

The hollow spaces limited by the circular meshworks 11 of space-framing plate 12 also open on the side walls of space-framing plate 12 in openings 15, 16, which correspond to the openings 15, 16 of the top of the space-framing plate, as well as in three openings 17. The two-layer complementary space-framing elements 1 (FIG. 6A) or 2 (FIG. 6B) can be built into openings 15, while the two-layer complementary space-framing elements 3 (FIG. 3C) are inserted into openings 16. Openings 17 on three sides of space-framing plate 12 are closed by rectangular, two-layer complementary space-framing elements 4 (FIG. 7). Each complementary space-framing element 4 is composed of a series of half-octahedrons (½ O) and half-cuboctahedrons (½ CO) as elementary structural blocks. At the side walls of space-framing plate 12, a triangular screen and a rectangular screen of rods 6 and gusseted joints 7 is formed in this manner each in a plane in which side wall coverings (not shown) can be fastened in gusseted joints 7 (in the outside layer).

Figure 8:
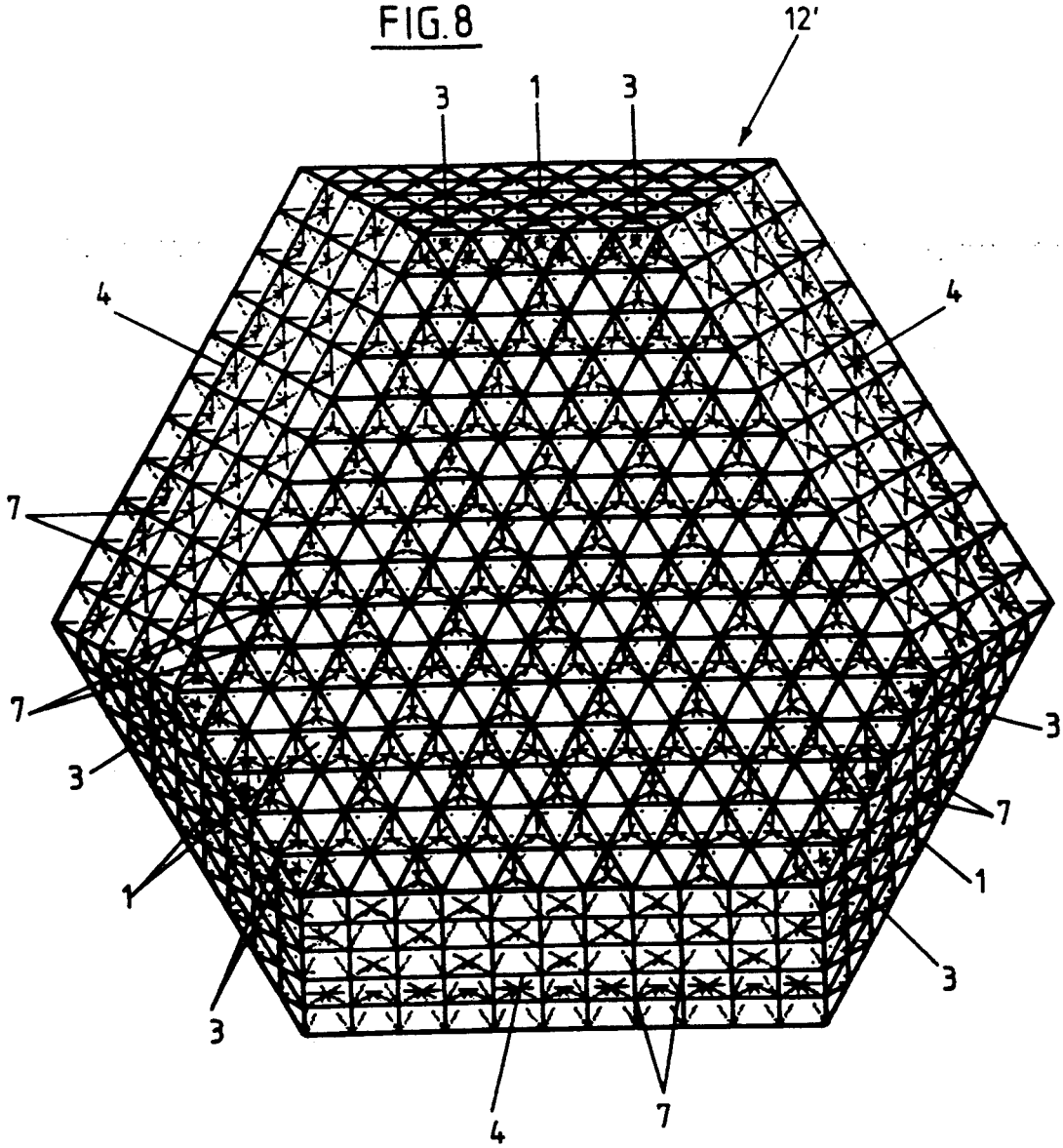
FIG. 8 is a plan view of the six-layer space-framing plate as in FIG. 2, but in this case with closed top and side walls according to the invention.

FIG. 8 shows space-framing plate 12' with closed top and side walls but without roofing or side wall covering. As already explained, the outer layers at the top and the side walls of space-framing plate 12' have either a triangular screen or both a triangular screen and a rectangular screen.

Figure 9:
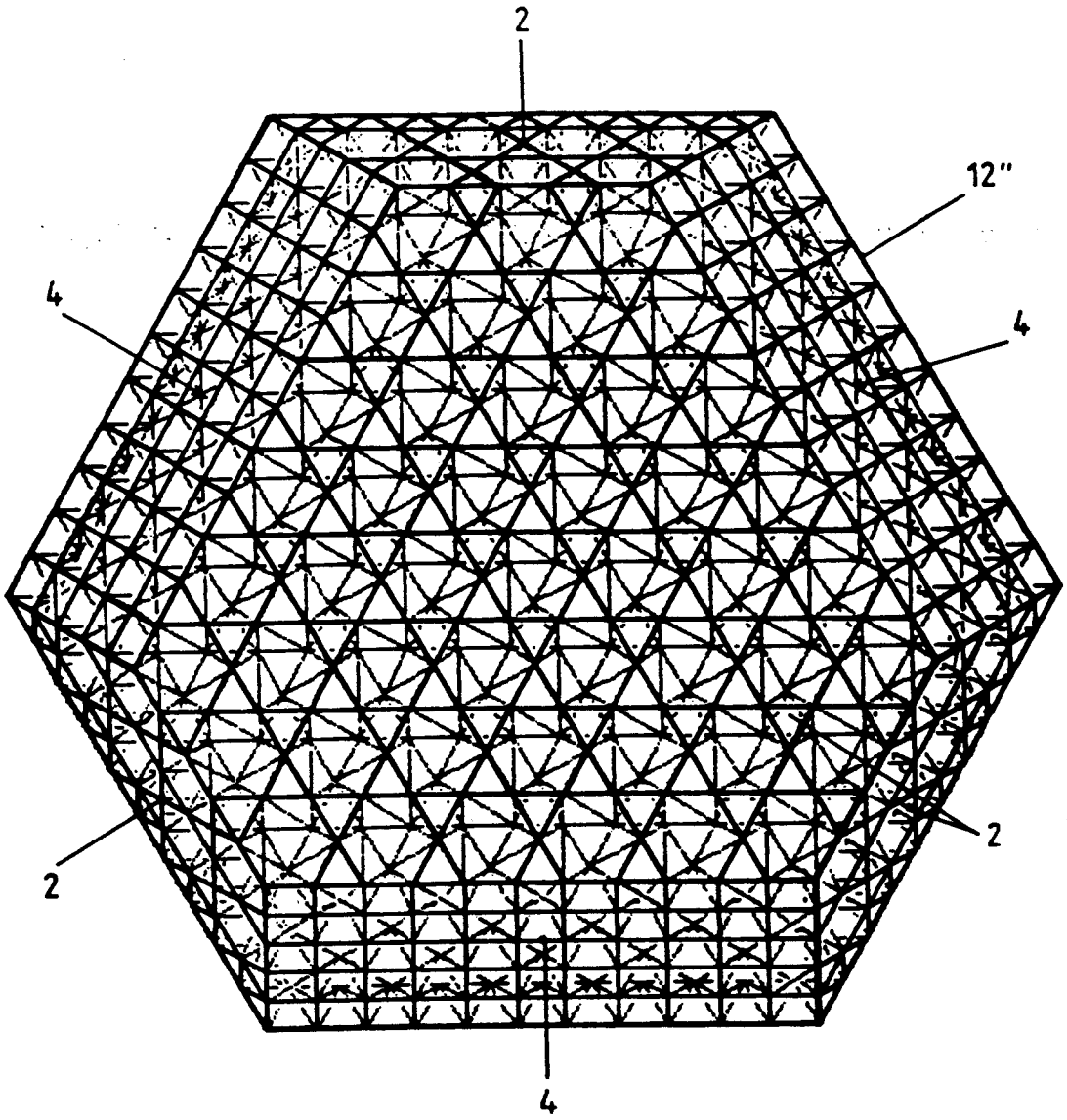
FIG. 9 is a plan view similar to that in FIG. 8 of the six-layer space-framing plate, but with alternatively closed top and side walls.

Space-framing plate 12" of FIG. 9 includes the complementary space-framing elements 2, 3 at the top and three side walls and at the remaining three side walls uses the complementary space-framing elements 4. The spade-framing plate 12" therefore has a hexagonal screen at its top and its three side walls and at the remaining three side walls it has a rectangular screen.

Figures 10, 11, 12:
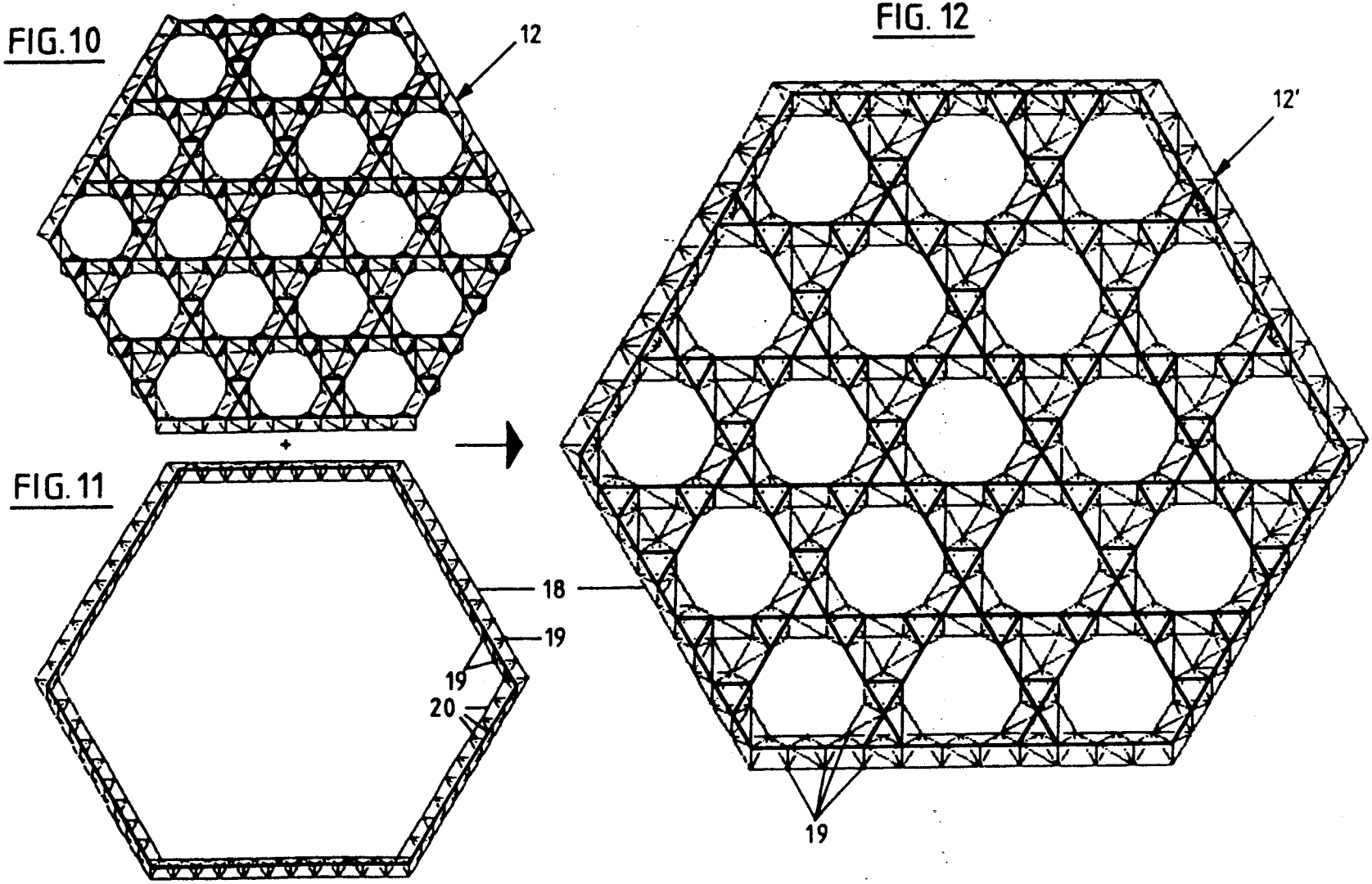
FIG. 10 is a crosscut section of the space-framing plate along the line X—X in FIG. 3 with a view of its two bottommost layers.
FIG. 11 is a plan view of a three-belt truss with hexagonal base line, which serves to extend and complement the edge of the space-framing plate of FIG. 10.
FIG. 12 is a plan view similar to that of FIG. 10 of the space-framing plate, but incorporating the integrated three-belt truss of FIG. 11.
Figure 13:
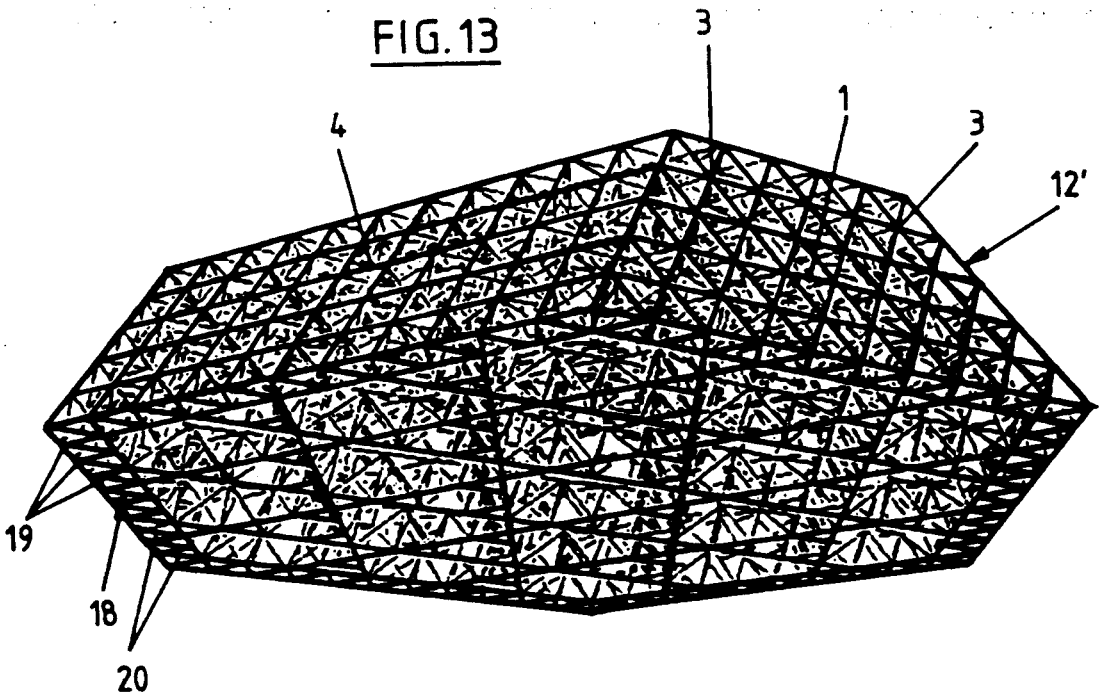
FIG. 13 is a perspective view of the space-framing plate of FIG. 8 seen from below, in order to show the three-belt truss.

The two bottom layers of space-framing plate 12 (FIGS. 1 to 5) are shown in FIG. 10. The bearing edges of the space-framing plate 12' form a three-belt truss 18 made up of rods 20 joining at gusseted joints 19. Three-belt trusses 18 form a hexagon and are incorporated into both of the bottom layers of space-framing plate 12', so that gusseted joints 19 serving as bearings lie in one plane. This is shown clearly in FIG. 13, which also shows that at the bottom of space-framing plate 12' the openings of the hollow spaces defined by circular meshworks 11 are open.

Figure 14:
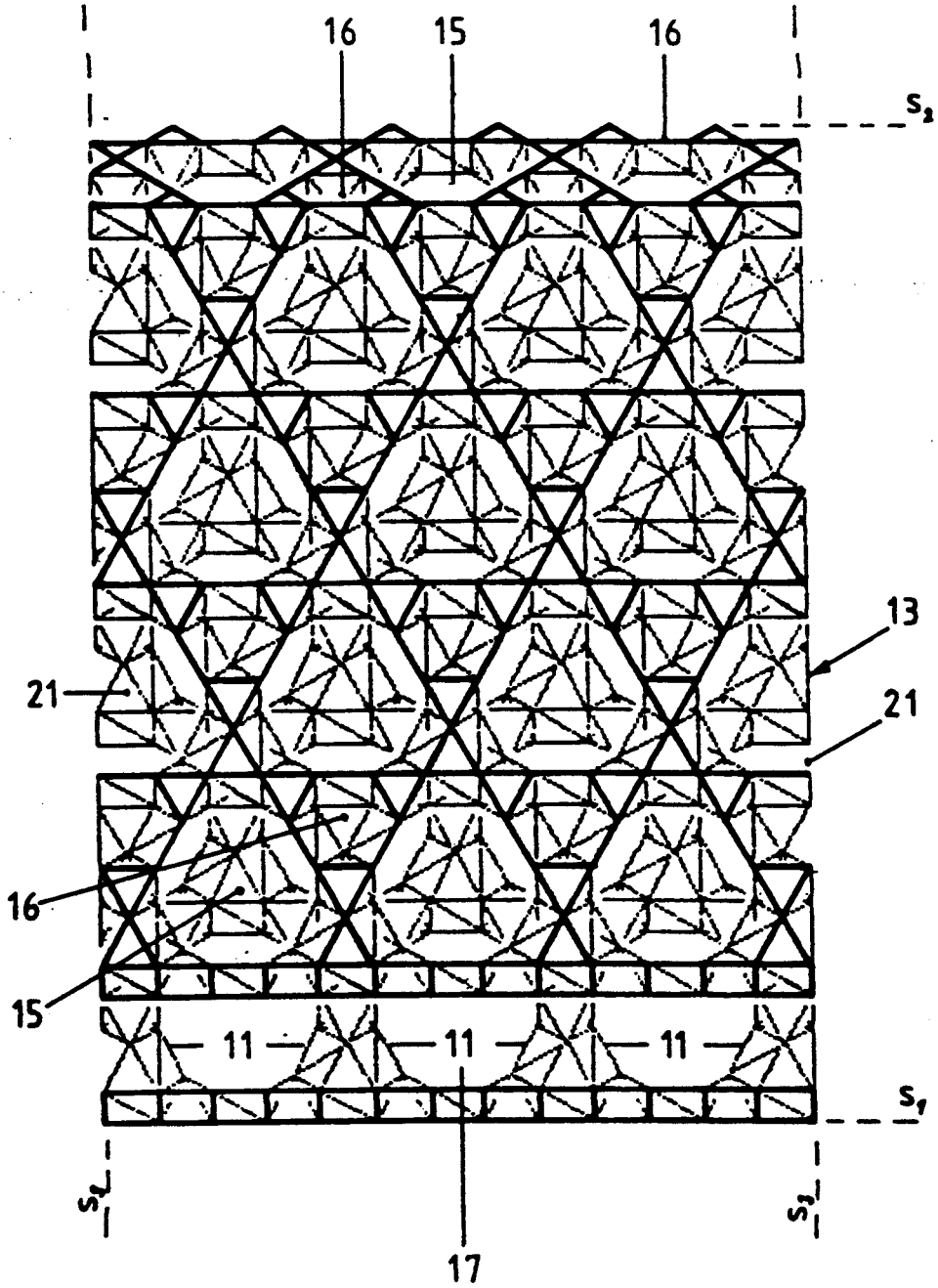
FIG. 14 is a plan view of a space-framing plate with rectangular base line corresponding to the construction shown in FIG. 1 in broken lines with openings on its top and side walls which are still open defined by the circular meshwork elements.
Figure 15:
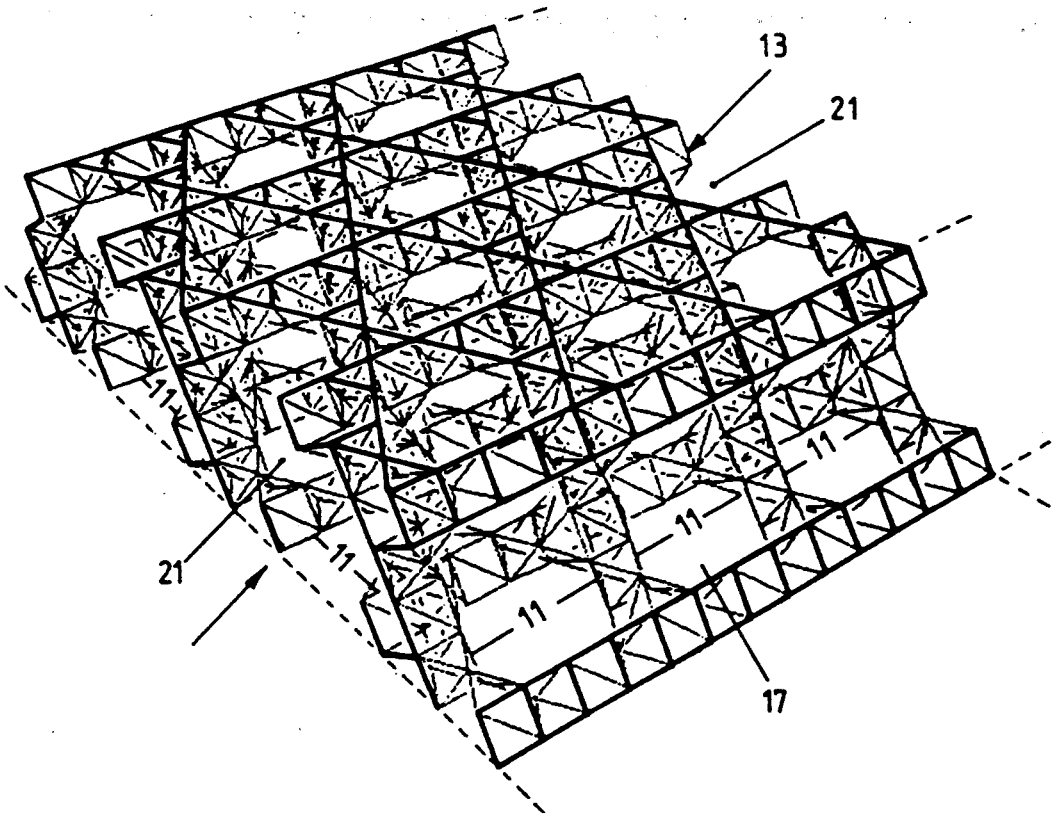
FIG. 15 is a perspective view of the space-framing plate of FIG. 14 seen from above.
Figure 16:
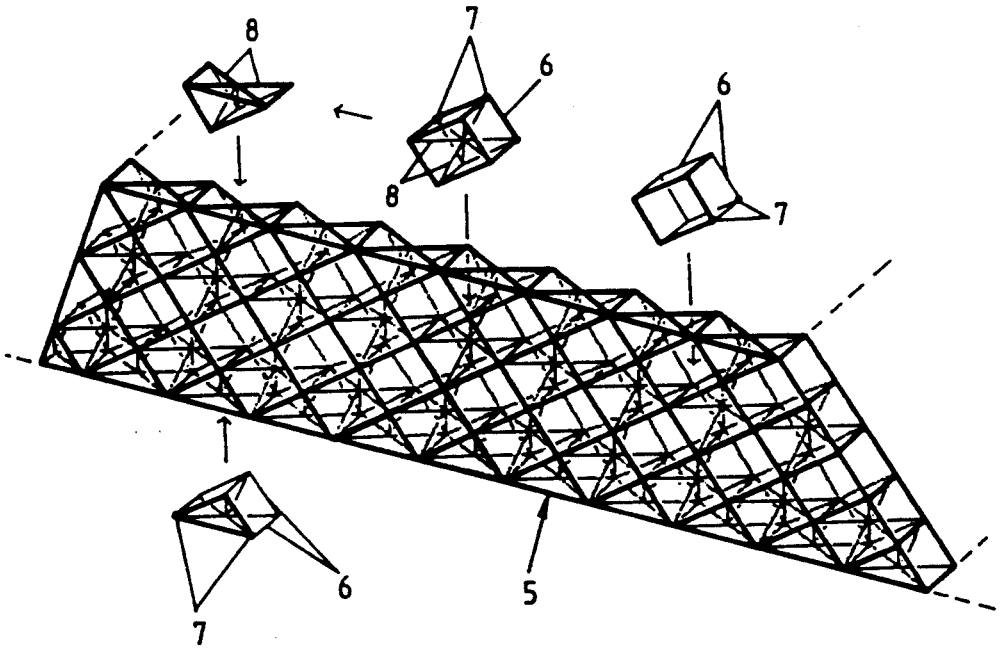
FIG. 16 is a perspective view of a fifth embodiment of a two-layer complementary space-framing element and its typical elementary structural blocks.
Figure 17:
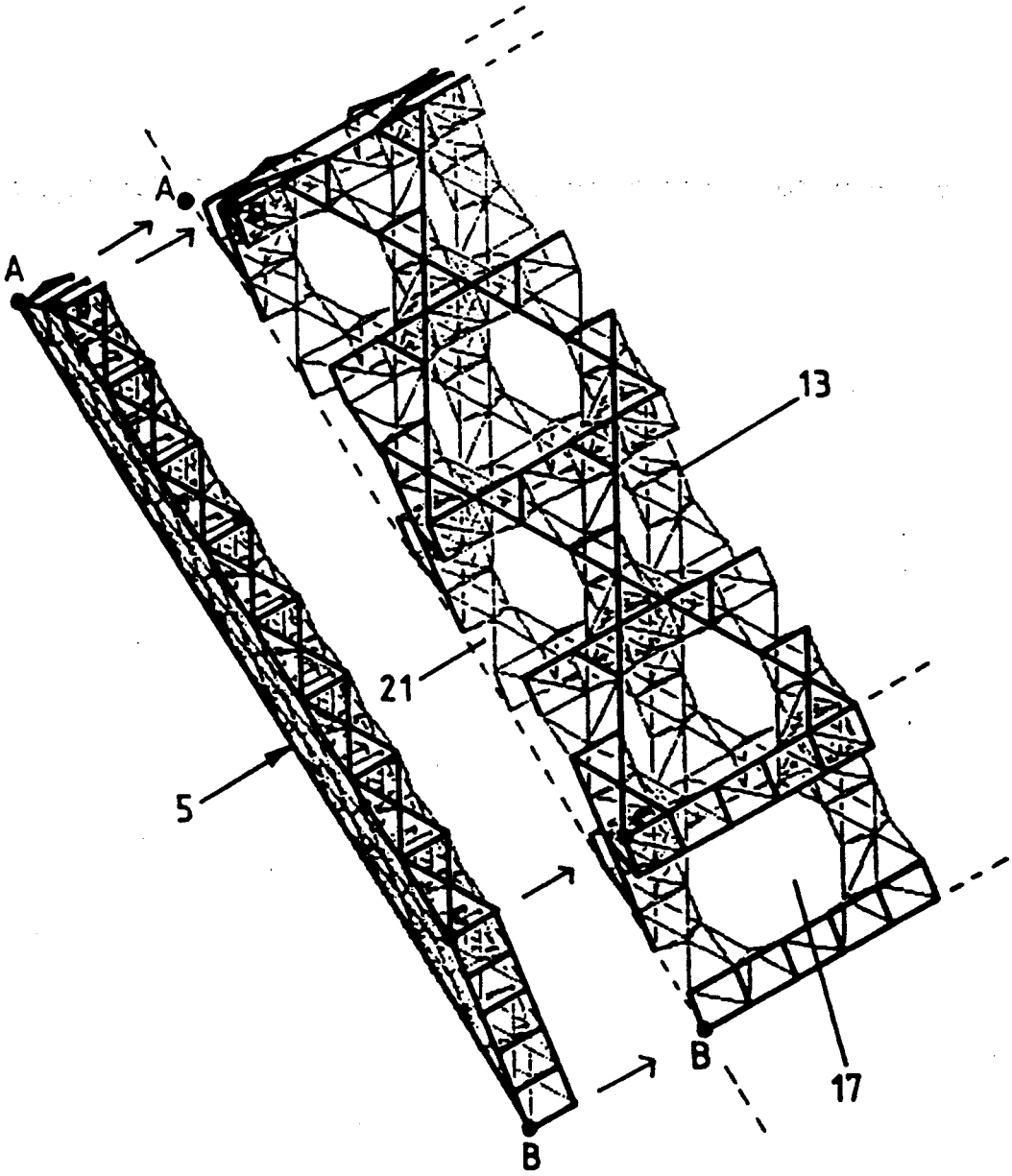
FIG. 17 is a perspective partial view of the space-framing plate of FIGS. 14 and 15 seen from above in connection with the complementary space-framing element of FIG. 16, which for the closing of the openings defined by the circular meshworks serves in both of the vertical side walls of this space-framing plate.

The six-layer space-framing plate 13 having a rectangular base line and shown in FIGS. 14 and 15 as well as broken line in FIG. 1 has two vertical side walls along intersection lines S3 and oblique side walls along intersection lines S1 and S2 with an inclination angle of approximately 54° or approximately 70° to the horizontal. In opening 17 of the hollow spaces defined by circular meshworks 11 at the one side wall the two-layer complementary space-framing element 4 (FIG. 7) is built into the opening. A two-layer complementary space-framing element 5 (FIG. 6) is used in each opening 21 of the hollow spaces defined by circular meshworks 11 on both vertical side walls of space-framing plate 13 in turn, as is shown in FIG. 17 in the left side wall of space-framing plate 13. There are two-layer complementary space-framing element 5 to be introduced into the corresponding openings 21 is shown on the one vertical side wall of the space-framing plate 13, in other words, it is therefore still at some distance from the plate. Each of the two complementary space-framing elements 5 is composed of a series of elementary structural blocks of rods 6 and gusseted joints 7, indeed of rectangular prisms, rectangular prisms with diagonal rods 8 and half-rectangular prisms (FIG. 16).

Figure 18:
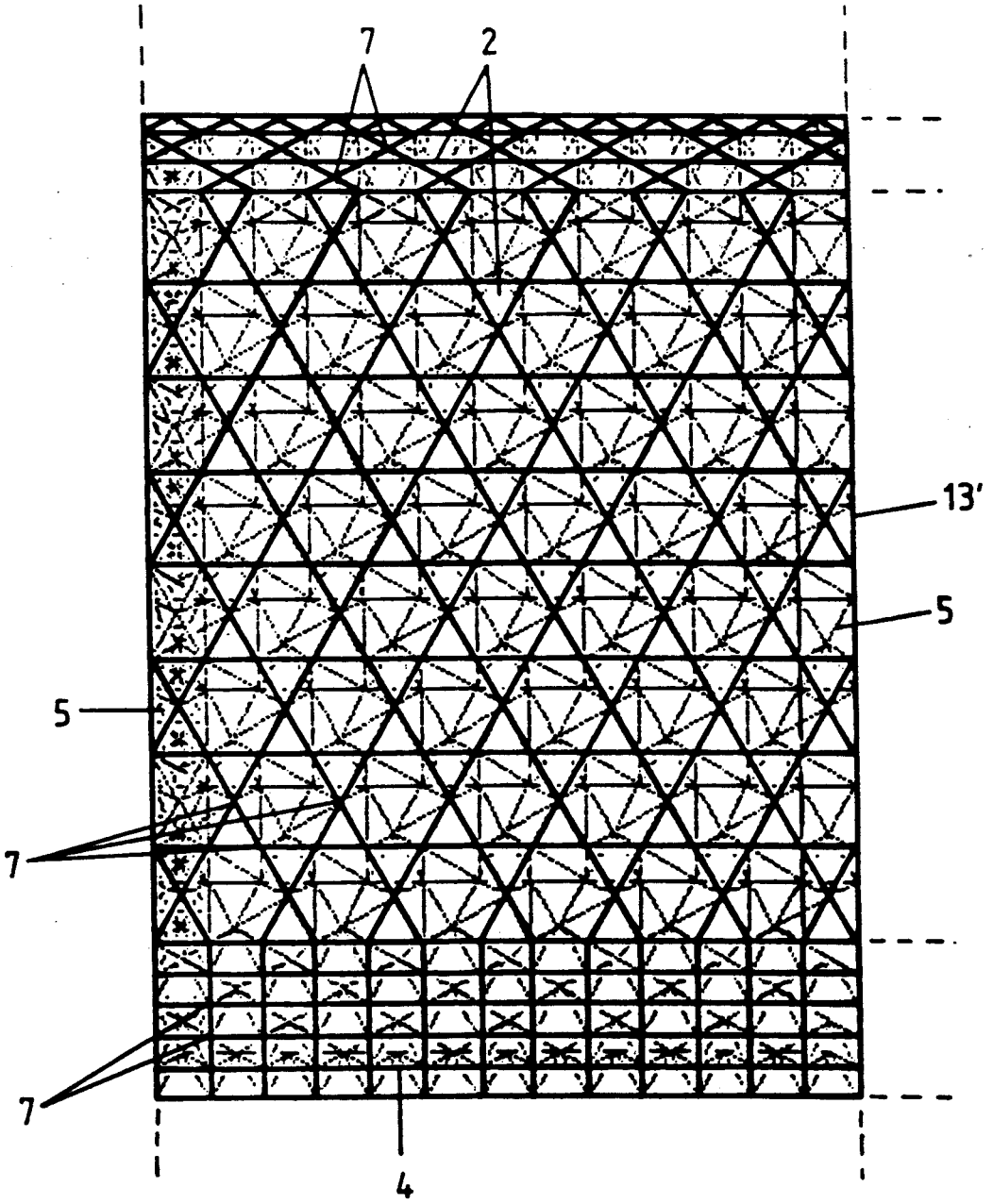
FIG. 18 is a plan view of the space-framing plate of FIGS. 14 and 15, in which however the openings defined by the circular meshworks at the top and side walls are closed according to the invention by complementary space-framing elements.
Figure 19:
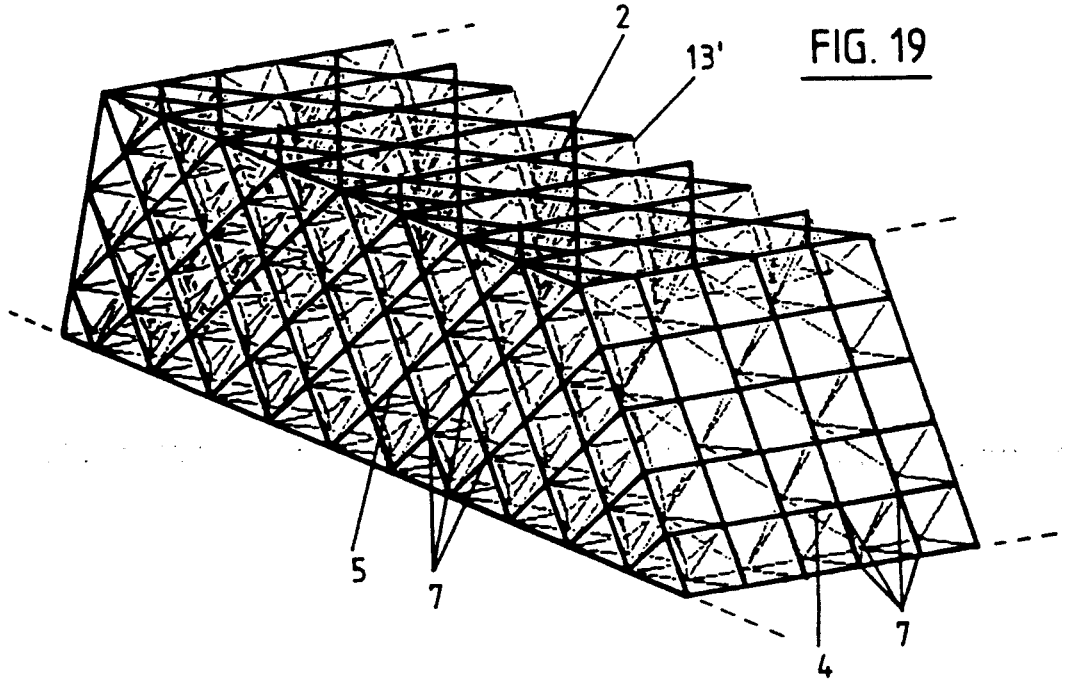
FIGS. 19 and 20 are two perspective partial views of the space-framing plate with rectangular base line, in turn with different complementary space-framing elements on the oblique side walls.
Figure 20:
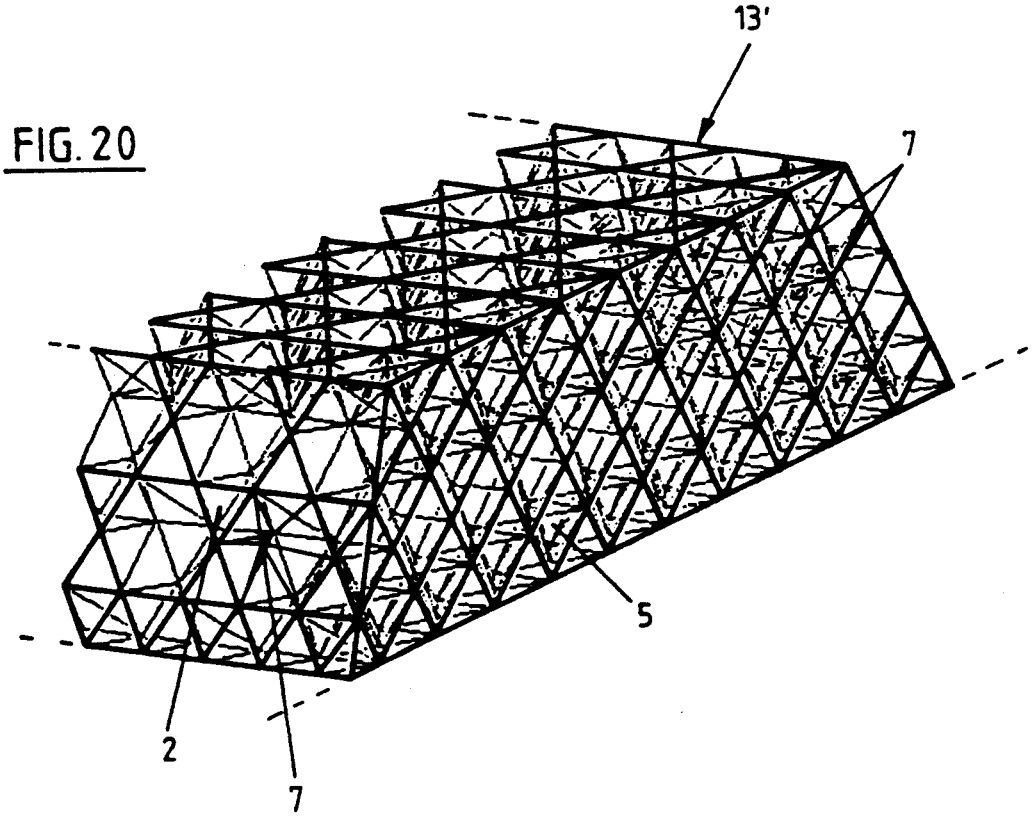

The openings 15, 16 at the other oblique side wall of space-framing plate 13 as well as at the top of space-framing plate 13, as in the case of the exemplary embodiment of FIGS. 2–13, can be closed either with the two-layer complementary space-framing elements 1 and 3 (FIGS. 6A, 6C) or with the complementary space-framing elements 2 and 3 (FIGS. 6B, 6C). In FIG. 18 the six-layer space-framing plate 13' is shown in closed sate at the top and along the four side walls (without roofing and side wall covering). At the top and along one side wall a hexagonal screen is thus produced, and a rectangular screen along the remaining three side walls. There is another advantage with this exemplary embodiment, and that is that the complementary space-framing elements (e.g. 2 and 4) are composed primarily of the same elementary structural blocks as the circular meshworks 11 of space-framing plate 13 or 13'. In this case surely the complementary space-framing elements 3 and 5 are tetrahedrons and rectangular prisms formed partially with diagonal rods, or else half-rectangular prisms are required. At the top and the side walls of space-framing plate 13' in the outer layer are found the gusseted joints 7 arranged in the screen, arranged in turn in a plane, so that a (not shown) roofing or a side wall covering can be fastened onto said gusseted joints 7.

I claim:

1. Multiple-layer space-frame plate, comprising a plurality of struts and a plurality of nodes defined by the intersection of at least two of said struts, said struts and nodes forming a plurality of substantially annular meshworks arranged and interconnected in a honeycomb-like structure having an outer surface including top, bottom and side walls, said annular meshworks having elementary structural cells which include cells in the shape of cuboctrahedrons, octahedrons and parts of the same supported by diagonal struts, said annular meshworks defining a plurality of openings in the top and sidewalls of said structure, and further including a plurality of complementary space-frame members which fit into said openings and form support grids therein which are adjacent the outer surface of said structure, thereby enabling covering members to be supported on said top and side walls of said structure.

2. Multiple-layer space-frame plate as defined in claim 1, wherein said complementary space-frame members are two-layer space-frame members some of which are constructed of elementary cells which include a series of half-octahedrons and half-cuboctahedrons, thereby defining support grids which have a plurality of relatively small rectangular shaped openings therein.

3. Multiple-layer space-frame plate as defined in claim 1, wherein said bottom wall has a substantially rectangular shape perimeter, and said structure includes a pair of opposed substantially vertical sidewalls and a pair of opposed angular sidewalls.

4. Multiple-layer space-frame plate as defined in claim 3, wherein said openings in said vertical sidewalls have complementary two-layer space-frame members thereon which have elementary cells which include a plurality of rectangular prisms, some of said rectangular prisms having diagonal struts therein, and half-rectangular prisms, and further wherein said openings in one of said angular side walls has a complementary two-layer space-frame member therein which includes a series of half-octahedrons and half-cuboctahedrons.

5. Multiple-layer space-frame plate as defined in claim 1, wherein said complementary space-frame members are two-layer space-frame members some of which are constructed of elementary cells which include nine tetrahedrons, three half-octahedrons, one octahedron and three half-cuboctahedrons and others are constructed of elementary cells which include three half-octahedrons and four tetrahedrons, thereby defining support grids which have a plurality of relatively small triangular shaped openings therein.

6. Multiple-layer space-frame plate as defined in claim 5, wherein said complementary space-frame members are two-layer space-frame members some of which are constructed of elementary cells which include a series of half-octahedrons and half-cuboctahedrons, thereby defining support grids which have a plurality of relatively small rectangular shaped openings therein.

7. Multiple-layer space-frame plate as defined in claim 1, wherein said complementary space-frame members are two-layer space-frame members some of which are constructed of elementary cells which include six half-cuboctahedrons and one octahedron and others are constructed of elementary cells which include three half-octahedrons and four tetrahedrons.

8. Multiple-layer space-frame plate as defined in claim 7, wherein said complementary space-frame members are two-layer space-frame members some of which are constructed of elementary cells which include a series of half-octahedrons and half-cuboctahedrons, thereby defining support grids which have a plurality of relatively small rectangular shaped openings therein.

9. Multiple-layer space-frame plate as defined in claim 1, wherein said bottom wall has a hexagonal shape perimeter.

10. Multiple-layer space-frame plate as defined in claim 9, wherein said side walls have an angle of approximately 54 degrees relative to said bottom wall.

11. Multiple-layer space-frame plate as defined in claim 9, wherein said side walls have an angle of approximately 70 degrees relative to said bottom wall.

* * * * *